US011142815B2

(12) United States Patent
Wyatt-Mair et al.

(10) Patent No.: US 11,142,815 B2
(45) Date of Patent: Oct. 12, 2021

(54) METHODS OF OFF-LINE HEAT TREATMENT OF NON-FERROUS ALLOY FEEDSTOCK

(71) Applicant: ARCONIC TECHNOLOGIES LLC, Pittsburgh, PA (US)

(72) Inventors: Gavin F. Wyatt-Mair, LaFayette, CA (US); David A. Tomes, San Antonio, TX (US); William D. Bennon, Kittanning, PA (US); Raymond J. Kilmer, Pittsburgh, PA (US); James C. Riggs, San Antonio, TX (US); Ali Unal, Export, PA (US); John M. Newman, Export, PA (US); Thomas N. Rouns, Pittsburgh, PA (US)

(73) Assignee: ARCONIC TECHNOLOGIES LLC, Pittsburgh, PA (US)

( * ) Notice: Subject to any disclaimer, the term of this patent is extended or adjusted under 35 U.S.C. 154(b) by 939 days.

(21) Appl. No.: 14/793,408

(22) Filed: Jul. 7, 2015

(65) Prior Publication Data

US 2017/0009325 A1 Jan. 12, 2017

(51) Int. Cl.
*C22F 1/16* (2006.01)
*C22F 1/10* (2006.01)
(Continued)

(52) U.S. Cl.
CPC ..... *C22F 1/183* (2013.01); *C22F 1/043* (2013.01); *C22F 1/047* (2013.01); *C22F 1/053* (2013.01);
(Continued)

(58) Field of Classification Search
CPC ..... C22F 1/04
(Continued)

(56) References Cited

U.S. PATENT DOCUMENTS 5,514,228 A 5/1996 Wyatt-Mair et al.
5,515,908 A 5/1996 Harrington
(Continued)

FOREIGN PATENT DOCUMENTS

JP 10-298668 11/1998
JP 2007-523262 A 8/2007
(Continued)

OTHER PUBLICATIONS

Rudnev et al. "History and Applications." ASM Handbook, vol. 4C, Induction Heating and Heat Treatment. pp. 3-5. 2014. (Year: 2014).*
(Continued)

*Primary Examiner* — Brian D Walck
(74) *Attorney, Agent, or Firm* — Greenberg Traurig, LLP

(57) ABSTRACT

The present invention, in some embodiments, is a method of forming an O temper or T temper product that includes obtaining a coil of a non-ferrous alloy strip as feedstock; uncoiling the coil of the feedstock; heating the feedstock to a temperature between a recrystallization temperature of the non-ferrous alloy and 10 degrees Fahrenheit below a solidus temperature of the non-ferrous alloy; and quenching the feedstock to form a heat-treated product having am O temper or T temper. The non-ferrous alloy strip used in the method excludes aluminum alloys having 0.4 weight percent silicon, less than 0.2 weight percent iron, 0.35 to 0.40 weight percent copper, 0.9 weight percent manganese, and 1 weight percent magnesium.

18 Claims, 3 Drawing Sheets

(51) Int. Cl.

| | |
|---|---|
| ***C22F 1/08*** | (2006.01) |
| ***C22F 1/06*** | (2006.01) |
| ***C22F 1/18*** | (2006.01) |
| ***C22F 1/057*** | (2006.01) |
| ***C22F 1/053*** | (2006.01) |
| ***C22F 1/047*** | (2006.01) |
| ***C22F 1/043*** | (2006.01) |

(52) U.S. Cl.
CPC ..... *C22F 1/057* (2013.01); *C22F 1/06* (2013.01); *C22F 1/08* (2013.01); *C22F 1/10* (2013.01); *C22F 1/16* (2013.01); *C22F 1/165* (2013.01)

(58) Field of Classification Search
USPC ..... 148/666
See application file for complete search history.

(56) References Cited

U.S. PATENT DOCUMENTS

| | | | | |
|---|---|---|---|---|
| 5,769,972 | A | 6/1998 | Sun et al. | |
| 6,045,632 | A * | 4/2000 | Sun | B22D 11/0605 148/551 |
| 6,391,127 | B1 * | 5/2002 | Wyatt-Mair | C22F 1/04 148/551 |
| 6,672,368 | B2 | 1/2004 | Unai | |
| 6,764,559 | B2 | 7/2004 | Li et al. | |
| 7,125,612 | B2 | 10/2006 | Unai | |
| 2004/0094245 | A1 | 5/2004 | Li et al. | |
| 2005/0183801 | A1 | 8/2005 | Unal et al. | |
| 2005/0211350 | A1 | 9/2005 | Unal et al. | |

FOREIGN PATENT DOCUMENTS

| | | | |
|---|---|---|---|
| JP | 2018-521178 | A | 8/2018 |
| WO | 97/11205 | A1 | 3/1997 |
| WO | 2005080619 | A1 | 1/2005 |
| WO | WO2010/049445 | A1 | 5/2010 |
| WO | 2017/007458 | A1 | 1/2017 |

OTHER PUBLICATIONS

Goldstein, Robert. "Magnetic Flux Controllers in Induction Heating and Melting." ASM Handbook, vol. 4C, Induction Heating and Heat Treatment. pp. 633-645. 2014. (Year: 2014).*

Waggott, R., et al., "Transverse flux induction heating of aluminium alloy strip", in *Heat Treatment* '81, The Metals Society, pp. 3-9, 1983.

Brawers, T., et al., "Experience with a 2.8 MW TFX Transverse Flux Continuous Thermal Treatment Line for Aluminium Strip", Proceedings International Congress New Developments in Metallurgical Processing, Dusseldorf, Germany, vol. 2, pp. 1-17, May 1989.

Gibson, R.C., et al., "IFX An Induction Heating Process for the Ultra Rapid Heat Treatment of Metal Strip," Materials Science Forum, vols. 102-104:3 73-3 82, 1992.

Ireson, R., C. J., "TFX induction annealing of aluminium strip: experience in Japan with first production line," Aluminium Technology '86, The Institute of Metals, pp. 818-825, Ed. T. Sheppard, 1986.

Walker, D. J., et al., "Metallurgy of rapid heat treatment of aluminium alloy strip by transverse flux induction heating," Aluminium Technology '86, The Institute of Metals, pp. 373-382, Ed. T. Sheppard, 1986.

Gibson, R.C., et al., "High efficiency induction heating as a production tool for heat treatment of continuous strip metal", Heat Treatment Technology, Sheet Metal Industries, Dec. 1982, vol. 59, No. 12, pp. 889-892.

ASM Handbook, vol. 4: Heat Treating, "Heat Treating of Aluminum Alloys" pp. 841-879, 1991 ASM International.

Aluminium Industry, vol. 7, No. 1, Jan. 1988, "Heat Treatment of Strip Aluminium Using TFX," pp. 14-18.

* cited by examiner

METHODS OF OFF-LINE HEAT TREATMENT OF NON-FERROUS ALLOY FEEDSTOCK

TECHNICAL FIELD

The present invention relates to heat treatment of cast metal alloys.

BACKGROUND

Annealing and solution heat treatment of cast metal alloys is known.

SUMMARY OF INVENTION

In some embodiments, the method includes obtaining a coil of a non-ferrous alloy strip as feedstock; uncoiling the coil of the feedstock; heating the feedstock to a temperature between a recrystallization temperature of the non-ferrous alloy and 10 degrees Fahrenheit below a solidus temperature of the non-ferrous alloy; and quenching the feedstock to form a heat-treated product having a temper. In some embodiments, the temper is O temper or T temper; and the non-ferrous alloy strip excludes aluminum alloys having all of the following 0.4 weight percent silicon, less than 0.2 weight percent iron, 0.35 to 0.40 weight percent copper, 0.9 weight percent manganese, and 1 weight percent magnesium.

In some embodiments, the heating is selected from the group consisting of infrared, radiant-tube, gas-fired furnace, direct resistance, induction heating, and combination thereof. In some embodiments, the non-ferrous alloy is selected from the group consisting of aluminum alloys, magnesium alloys, titanium alloys, copper alloys, nickel alloys, zinc alloys and tin alloys. In some embodiments, the non-ferrous alloy is an aluminum alloy selected from the group consisting of 2xxx, 3xxx, 6xxx, 7xxx, and 8xxx series aluminum alloys.

In some embodiments, the non-ferrous alloy is a magnesium alloy. In some embodiments, the method further comprises recoiling the heat-treated product to form a second coil. In some embodiments, the heating temperature is between the recrystallization temperature of the non-ferrous alloy and 30 degrees Fahrenheit below the solidus temperature of the non-ferrous alloy.

In some embodiments, the heating temperature is between the recrystallization temperature of the non-ferrous alloy and 60 degrees Fahrenheit below the solidus temperature of the non-ferrous alloy. In some embodiments, the heating temperature is between the recrystallization temperature of the non-ferrous alloy and 85 degrees Fahrenheit below the solidus temperature of the non-ferrous alloy.

In some embodiments, the non-ferrous alloy is aluminum alloy and the heating temperature is between 600 and 1100 degrees Fahrenheit. In some embodiments, the non-ferrous alloy is magnesium alloy and the heating temperature is between 550 and 930 degrees Fahrenheit.

In some embodiments, the method comprises obtaining a coil of a non-ferrous alloy strip as feedstock; uncoiling the coil of the feedstock; heating the feedstock to a temperature between a recrystallization temperature of the non-ferrous alloy and 10 degrees Fahrenheit below a solidus temperature of the non-ferrous alloy for a heating duration of 0.5 to 55 seconds; and quenching the feedstock to form a heat-treated product having a temper.

In some embodiments, the temper is O temper or T temper; and the non-ferrous alloy strip excludes aluminum alloys having all of the following 0.4 weight percent silicon, less than 0.2 weight percent iron, 0.35 to 0.40 weight percent copper, 0.9 weight percent manganese, and 1 weight percent magnesium.

In some embodiments, the non-ferrous alloy is selected from the group consisting of aluminum alloys, magnesium alloys, titanium alloys, copper alloys, nickel alloys, zinc alloys and tin alloys. In some embodiments, the non-ferrous alloy is an aluminum alloy selected from the group consisting of 2xxx, 3xxx, 6xxx, 7xxx, and 8xxx series aluminum alloys. In some embodiments, the non-ferrous alloy is a magnesium alloy.

In some embodiments, the heating duration is 0.5 to 20 seconds. In some embodiments, the heating duration is 0.5 to 15 seconds. In some embodiments, the non-ferrous alloy is an aluminum alloy and the heating temperature is between 600 and 1100 degrees Fahrenheit. In some embodiments, the non-ferrous alloy is magnesium alloy and the heating temperature is between 550 and 930 degrees Fahrenheit. In some embodiments, the temper is selected from the group consisting of T4 and T4X.

Figure 1:
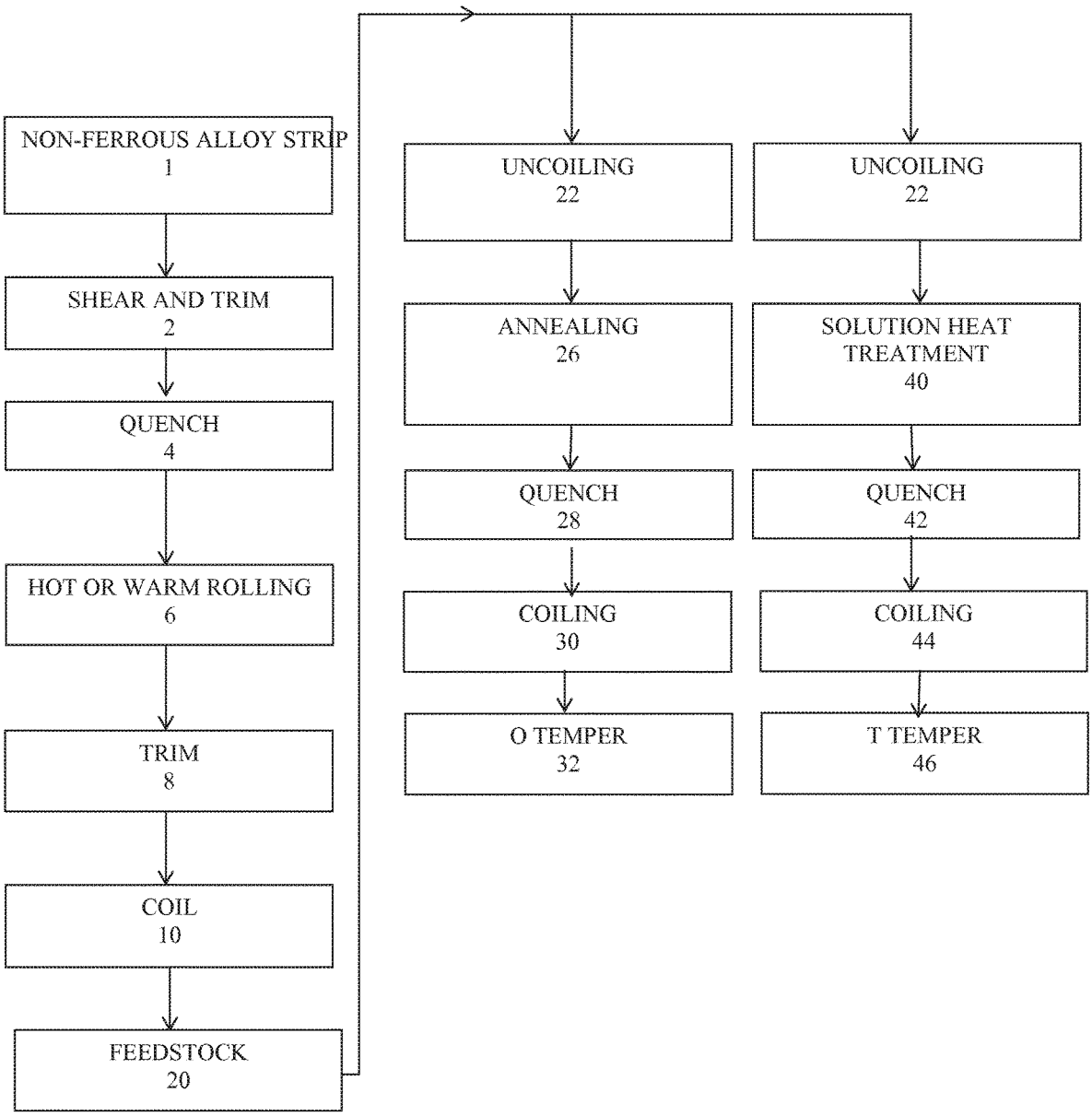
FIG. 1 illustrates features of some embodiments of the present invention.

The present invention will be further explained with reference to the attached drawings, wherein like structures are referred to by like numerals throughout the several views. The drawings shown are not necessarily to scale or aspect ratio, with emphasis instead generally being placed upon illustrating the principles of the present invention. Further, some features may be exaggerated to show details of particular components.

The figures constitute a part of this specification and include illustrative embodiments of the present invention and illustrate various objects and features thereof. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

DETAILED DESCRIPTION

The present invention will be further explained with reference to the attached drawings, wherein like structures are referred to by like numerals throughout the several views. The drawings shown are not necessarily to scale, with emphasis instead generally being placed upon illustrating the principles of the present invention. Further, some features may be exaggerated to show details of particular components.

The figures constitute a part of this specification and include illustrative embodiments of the present invention and illustrate various objects and features thereof. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

As used herein, the term "anneal" refers to a heating process that primarily causes recrystallization of the metal to occur. In some embodiments, anneal may further include dissolution of soluble constituent particles based, at least in part, on the size of the soluble constituent particles and the annealing temperature. In embodiments, temperatures used in annealing aluminum alloys range from about 600 to 900° F. In embodiments, temperatures used in annealing copper alloys range from about 700 to 1700° F. In embodiments, temperatures used in annealing magnesium alloys range from about 550 to 850° F. In embodiments, temperatures used in annealing nickel alloys range from about 1400 to 2220° F. In embodiments, temperatures used in annealing titanium alloys range from about 1200 to 1650° F. In embodiments, temperatures used in annealing other non-ferrous alloys may include any of the temperature ranges detailed above.

Also as used herein, the term "solution heat treatment" refers to a metallurgical process in which the metal is held at a high temperature so as to cause the second phase particles of the alloying elements to dissolve into solid solution. Temperatures used in solution heat treatment are generally higher than those used in annealing, and range up to about 1100° F. for aluminum alloys. This condition is then maintained by quenching of the metal for the purpose of strengthening the final product by controlled precipitation (aging). In embodiments, temperatures used in solution heat treatment of copper alloys range from 1425 to 1700° F. In embodiments, temperatures used in solution heat treatment of magnesium alloys range from 750 to 930° F. In embodiments, temperatures used in solution heat treatment of nickel alloys range from 1525 to 2260° F. In embodiments, temperatures used in solution heat treatment of titanium alloys range from 1400 to 1850° F. In embodiments, temperatures for solution heat treatment of other non-ferrous alloys may include any of the temperature ranges detailed above.

As used herein, the term "feedstock" refers to a non-ferrous alloy in strip form. The feedstock employed in the practice of the present invention can be prepared by any casting techniques known to those skilled in the art including, but not limited to direct chill casting and continuous casting. In some embodiments, the feedstock is generated using an ingot process, belt casters, and/or roll casters. In some embodiments, the feedstock is a non-ferrous alloy strip produced using a method described in U.S. Pat. Nos. 5,515,908; 6,672,368; and 7,125,612 each of which are assigned to the assignee of the present invention and incorporated by reference in its entirety.

In some embodiments, the feedstock may have been optionally subjected to one or more of the following steps prior to heating: shearing, trimming, quenching, hot and/or cold rolling, and/or coiling. In some embodiments, the feedstock is hot and/or cold rolled until the final predetermined gauge is reached and then coiled to form a coiled feedstock.

As used herein, "strip" may be of any suitable thickness, and is generally of sheet gauge (0.006 inch to 0.249 inch) or thin-plate gauge (0.250 inch to 0.400 inch), i.e., has a thickness in the range of 0.006 inch to 0.400 inch. In one embodiment, the strip has a thickness of at least 0.040 inch. In one embodiment, the strip has a thickness of no greater than 0.320 inch. In one embodiment, the strip has a thickness of from 0.0070 to 0.018, such as when used for canning/packaging applications. In some embodiments, the strip has a thickness in the range of 0.06 to 0.25 inch. In some embodiments, the strip has a thickness in the range of 0.08 to 0.14 inch. In some embodiments, the strip has a thickness in the range of 0.08 to 0.20 inch. In some embodiments, the strip has a thickness in the range of 0.1 to 0.25 inches in thickness.

In some embodiments, the non-ferrous alloy strip has a width up to about 90 inches, depending on desired continued processing and the end use of the strip. In some embodiments, the non-ferrous alloy strip has a width up to about 80 inches, depending on desired continued processing and the end use of the strip. In some embodiments, the non-ferrous alloy strip has a width up to about 70 inches, depending on desired continued processing and the end use of the strip. In some embodiments, the non-ferrous alloy strip has a width up to about 60 inches, depending on desired continued processing and the end use of the strip. In some embodiments, the non-ferrous alloy strip has a width up to about 50 inches, depending on desired continued processing and the end use of the strip.

As used herein, the term "solidus" temperature means the temperature below which a non-ferrous alloy is completely solid.

As used herein, the term "non-equilibrium melting" temperature means the temperature at which melting of a non-ferrous alloy occurs at less than the solidus temperature.

As used herein, the term "recrystallization temperature" means the lowest temperature at which the distorted grain structure of a cold-worked metal is replaced by a new, strain-free grain structure.

As used herein, the term "temperature" may refer to an average temperature, a maximum temperature, or a minimum temperature.

As used herein, the phrase "the aluminum alloy is selected from the group consisting of 1xxx, 2xxx, 3xxx, 4xxx, 5xxx, 6xxx, 7xxx, and 8xxx series aluminum alloys" and the like means an aluminum alloy selected from the group consisting of 1xxx, 2xxx, 3xxx, 4xxx, 5xxx, 6xxx, 7xxx, and 8xxx series aluminum alloys registered with the Aluminum Association and unregistered variants of the same and excluding aluminum alloys having all of the following: 0.4 weight percent silicon; less than 0.2 weight percent iron, 0.35 to 0.40 weight percent copper, 0.9 weight percent manganese, and 1 weight percent magnesium.

As used herein, "heating duration" means the time elapsed between the start of heating an alloy and the start of cooling an alloy.

As used herein, "non-ferrous alloys" means an alloy of an element such as aluminum, magnesium, titanium, copper, nickel, zinc or tin.

In some embodiments, the present invention relates to a method of making non-ferrous alloy strip in an off-line process. In some embodiments, the present invention relates to a method of heating a cast strip in an off-line process. In some embodiments, the method is used to make non-ferrous alloy strip of T (heat-treated) or O (annealed) temper having the desired properties by heating to a temperature above the recrystallization temperature and below the solidus or non-equilibrium melting temperature.

In some embodiments, the present invention relates to methods of manufacturing of non-ferrous alloy strip for use in commercial applications such as automotive, canning, food packaging, beverage containers and aerospace applications.

In some embodiments, the present invention is a method of manufacturing a non-ferrous alloy strip in an off-line process comprising obtaining a coil of a non-ferrous alloy strip as feedstock; uncoiling the coil of the feedstock; heating the feedstock to a temperature between a recrystallization temperature of the non-ferrous alloy and 10 degrees Fahrenheit below a solidus temperature of the non-ferrous alloy; and quenching the feedstock to form a heat-treated product having a temper. In some embodiments, the first temper is O temper, T temper, or W temper. In some embodiments, the quenching is conducted using liquid sprays, gas, gas followed by liquid, and/or liquid followed by gas.

In some embodiments, the feedstock is coiled to form a first coil. In some embodiments, the method further includes uncoiling the first coil. In some embodiments, the method further includes recoiling the aluminum alloy strip to form a second coil.

In some embodiments, the non-ferrous alloy is selected from the group consisting of aluminum alloys, magnesium alloys, titanium alloys, copper alloys, nickel alloys, zinc alloys and tin alloys.

In some embodiments, the non-ferrous alloy is an aluminum alloy selected from the group consisting of 2xxx, 3xxx, 6xxx, 7xxx, and 8xxx series aluminum alloys.

In some embodiments, the non-ferrous alloy is a magnesium alloy. In some embodiments, the non-ferrous alloy is a titanium alloy. In some embodiments, the non-ferrous alloy is a copper alloy. In some embodiments, the non-ferrous alloy is a nickel alloy. In some embodiments, the non-ferrous alloy is a zinc alloy. In some embodiments, the non-ferrous alloy is a tin alloy.

In some embodiments, the non-ferrous alloy strip excludes aluminum alloys having all of the following:

0.4 weight percent silicon, less than 0.2 weight percent iron, 0.35 to 0.40 weight percent copper, 0.9 weight percent manganese, and 1 weight percent magnesium.

In some embodiments, the heating is conducted using any type of heat treatment including, but not limited to, infrared, radiant-tube, gas-fired furnace, direct resistance and/or induction heat treatment. In some embodiments, the heat treatment is induction heating. In some embodiments, the induction heating is conducted using a heater that is configured for transverse flux induction heating ("TFIH").

In some embodiments, the feedstock has a uniform microstructure with fine constituents. In some embodiments, the feedstock achieves a uniform microstructure with fine constituents with the strip continuous casting methods detailed in U.S. Pat. Nos. 5,515,908; 6,672,368; and 7,125,612 each of which are assigned to the assignee of the present invention and incorporated by reference in its entirety. In some embodiments, as the time of solidification in the continuous casting methods may be short (<100 millisecond), the intermetallic compounds in the feedstock do not have time to grow to reach a size that would require high temperatures and longer holding times for dissolution. In some embodiments, the particles of the soluble $Mg_2Si$ phase in the feedstock are generally under 1 micron in size with an average particle size of about 0.3 microns. In the embodiments, the small soluble particles in the feedstock are suitable for rapid dissolution. In some embodiments, a high percentage of the solute in the feedstock tends to be in solution and thus requires no additional solutionizing.

In some embodiments, the small particle size of the intermetallic compounds and the large percentage of the solute in solution of the aluminum alloy strip facilitate the use of heating for solution heat treatment of alloys and/or age hardened alloys at lower temperatures. In some embodiments, the small particle size of the intermetallic compounds and the large percentage of the solute in solution of the aluminum alloy strip facilitate the use of induction heating for solution heat treatment of alloys and/or age hardened alloys at lower temperatures. In some embodiments, the process is enabled by uniform microstructures with fine constituents which can be solution heat treated at lower temperatures than needed for conventional ingot material thereby providing solutionization without the occurrence of localized strip melting. In some embodiments, the feedstock material may be processed at increased line speeds due to the lower temperatures required for heat treatment. In some embodiments, the heating is sufficient to restrict the growth of the $Mg_2Si$ particles while they are passing through the temperature range before dissolution starts. In some embodiments, the heating is sufficient to restrict the growth of the $Mg_2Si$ particles while they are passing through the temperature range above 800° F., as a non-limiting example, before dissolution starts. In some embodiments, the heated strip is then quenched to keep the solute in solution.

In some embodiments, the feedstock is heated to a temperature equal to a recrystallization temperature of the non-ferrous alloy. In some embodiments, the feedstock is heated to a temperature between a recrystallization temperature of the non-ferrous alloy and 85° F. below the solidus or non-equilibrium melting temperature of the non-ferrous alloy. In some embodiments, the feedstock is heated to a temperature between a recrystallization temperature of the non-ferrous alloy and 80° F. below the solidus or non-equilibrium melting temperature of the non-ferrous alloy. In some embodiments, the feedstock is heated to a temperature between a recrystallization temperature of the non-ferrous alloy and 70° F. below the solidus or non-equilibrium melting temperature of the non-ferrous alloy. In some embodiments, the feedstock is heated to a temperature between a recrystallization temperature of the non-ferrous alloy and 60° F. below the solidus or non-equilibrium melting temperature of the non-ferrous alloy. In some embodiments, the feedstock is heated to a temperature between a recrystallization temperature of the non-ferrous alloy and 50° F. below the solidus or non-equilibrium melting temperature of the non-ferrous alloy. In some embodiments, the feedstock is heated to a temperature between a recrystallization temperature of the non-ferrous alloy and 40° F. below the solidus or non-equilibrium melting temperature of the non-ferrous alloy. In some embodiments, the feedstock is heated to a temperature between a recrystallization temperature of the non-ferrous alloy and 30° F. below the solidus or non-equilibrium melting temperature of the non-ferrous alloy. In some embodiments, the feedstock is heated to a temperature between a recrystallization temperature of the non-ferrous alloy and 20° F. below the solidus or non-equilibrium melting temperature of the non-ferrous alloy. In some embodiments, the feedstock is heated to a temperature between a recrystallization temperature of the non-ferrous alloy and 10° F. below the solidus or non-equilibrium melting temperature of the non-ferrous alloy. In some embodiments, the feedstock is heated to a temperature between a recrystallization temperature of the non-ferrous alloy and 5° F. below the solidus or non-equilibrium melting temperature of the non-ferrous alloy. In some embodiments, the feedstock is heated to a temperature between a recrystallization temperature of the non-ferrous alloy and the solidus or non-equilibrium melting temperature of the non-ferrous alloy.

In some embodiments, the feedstock is heated to a temperature between a recrystallization temperature of the non-ferrous alloy and 100° F. below the solidus or non-equilibrium melting temperature of the non-ferrous alloy. In some embodiments, the feedstock is heated to a temperature between a recrystallization temperature of the non-ferrous alloy and 110° F. below the solidus or non-equilibrium melting temperature of the non-ferrous alloy. In some embodiments, the feedstock is heated to a temperature between a recrystallization temperature of the non-ferrous alloy and 120° F. below the solidus or non-equilibrium melting temperature of the non-ferrous alloy. In some embodiments, the feedstock is heated to a temperature between a recrystallization temperature of the non-ferrous alloy and 130° F. below the solidus or non-equilibrium melting temperature of the non-ferrous alloy. In some embodiments, the feedstock is heated to a temperature between a recrystallization temperature of the non-ferrous alloy and 140° F. below the solidus or non-equilibrium melting temperature of the non-ferrous alloy. In some embodiments, the feedstock is heated to a temperature between a recrystallization temperature of the non-ferrous alloy and 160° F. below the solidus or non-equilibrium melting temperature of the non-ferrous alloy. In some embodiments, the feedstock is heated to a temperature between a recrystallization temperature of the non-ferrous alloy and 180° F. below the solidus or non-equilibrium melting temperature of the non-ferrous alloy. In some embodiments, the feedstock is heated to a temperature between a recrystallization temperature of the non-ferrous alloy and 200° F. below the solidus or non-equilibrium melting temperature of the non-ferrous alloy.

In some embodiments, the feedstock is heated to a temperature between a recrystallization temperature of the non-ferrous alloy and 30 to 200° F. below the solidus or non-equilibrium melting temperature of the non-ferrous alloy. In some embodiments, the feedstock is heated to a temperature between a recrystallization temperature of the non-ferrous alloy and 50 to 200° F. below the solidus or non-equilibrium melting temperature of the non-ferrous alloy. In some embodiments, the feedstock is heated to a temperature between a recrystallization temperature of the non-ferrous alloy and 70 to 200° F. below the solidus or non-equilibrium melting temperature of the non-ferrous alloy. In some embodiments, the feedstock is heated to a temperature between a recrystallization temperature of the non-ferrous alloy and 100 to 200° F. below the solidus or non-equilibrium melting temperature of the non-ferrous alloy. In some embodiments, the feedstock is heated to a temperature between a recrystallization temperature of the non-ferrous alloy and 130 to 200° F. below the solidus or non-equilibrium melting temperature of the non-ferrous alloy. In some embodiments, the feedstock is heated to a temperature between a recrystallization temperature of the non-ferrous alloy and 170 to 200° F. below the solidus or non-equilibrium melting temperature of the non-ferrous alloy.

In some embodiments, the feedstock is heated to a temperature between a recrystallization temperature of the non-ferrous alloy and 40 to 200° F. below the solidus or non-equilibrium melting temperature of the non-ferrous alloy. In some embodiments, the feedstock is heated to a temperature between a recrystallization temperature of the non-ferrous alloy and 40 to 180° F. below the solidus or non-equilibrium melting temperature of the non-ferrous alloy. In some embodiments, the feedstock is heated to a temperature between a recrystallization temperature of the non-ferrous alloy and 40 to 160° F. below the solidus or non-equilibrium melting temperature of the non-ferrous alloy. In some embodiments, the feedstock is heated to a temperature between a recrystallization temperature of the non-ferrous alloy and 40 to 140° F. below the solidus or non-equilibrium melting temperature of the non-ferrous alloy. In some embodiments, the feedstock is heated to a temperature between a recrystallization temperature of the non-ferrous alloy and 40 to 120° F. below the solidus or non-equilibrium melting temperature of the non-ferrous alloy. In some embodiments, the feedstock is heated to a temperature between a recrystallization temperature of the non-ferrous alloy and 40 to 100° F. below the solidus or non-equilibrium melting temperature of the non-ferrous alloy. In some embodiments, the feedstock is heated to a temperature between a recrystallization temperature of the non-ferrous alloy and 40 to 80° F. below the solidus or non-equilibrium melting temperature of the non-ferrous alloy.

In some embodiments, the feedstock is heated to a temperature of 1° F. above the recrystallization temperature. In some embodiments, the feedstock is heated to a temperature of 10° F. above the recrystallization temperature. In some embodiments, the feedstock is heated to a temperature of 20° F. above the recrystallization temperature. In some embodiments, the feedstock is heated to a temperature of 30° F. above the recrystallization temperature. In some embodiments, the feedstock is heated to a temperature of 50° F. above the recrystallization temperature. In some embodiments, the feedstock is heated to a temperature of 75° F. above the recrystallization temperature. In some embodiments, the feedstock is heated to a temperature of 100° F. above the recrystallization temperature. In some embodiments, the feedstock is heated to a temperature of 125° F. above the recrystallization temperature. In some embodiments, the feedstock is heated to a temperature of 150° F.

above the recrystallization temperature. In some embodiments, the feedstock is heated to a temperature of 200° F. above the recrystallization temperature. In some embodiments, the feedstock is heated to a temperature of 250° F. above the recrystallization temperature. In some embodiments, the feedstock is heated to a temperature of 300° F. above the recrystallization temperature. In some embodiments, the feedstock is heated to a temperature of 350° F. above the recrystallization temperature. In some embodiments, the feedstock is heated to a temperature of 400° F. above the recrystallization temperature.

In some embodiments, the feedstock is an aluminum alloy heated to a temperature between 600 and 1100° F. In some embodiments, the feedstock is an aluminum alloy heated to a temperature of between 600 and 1050° F. In some embodiments, the feedstock is an aluminum alloy heated to a temperature of between 600 and 1000° F. In some embodiments, the feedstock is an aluminum alloy heated to a temperature of between 600 and 950° F. In some embodiments, the feedstock is an aluminum alloy heated to a temperature of between 600 and 900° F. In some embodiments, the feedstock is an aluminum alloy heated to a temperature of between 600 to 850° F. In some embodiments, the feedstock is an aluminum alloy heated to a temperature of between 600 to 800° F. In some embodiments, the feedstock is an aluminum alloy heated to a temperature of between 600 to 750° F. In some embodiments, the feedstock is an aluminum alloy heated to a temperature of between 600 to 700° F. In some embodiments, the feedstock is an aluminum alloy heated to a temperature of between 600 to 650° F.

In some embodiments, the feedstock is an aluminum alloy heated to a temperature of between 650 and 1100° F. In some embodiments, the feedstock is an aluminum alloy heated to a temperature of between 700 and 1100° F. In some embodiments, the feedstock is an aluminum alloy heated to a temperature of between 750 and 1100° F. In some embodiments, the feedstock is an aluminum alloy heated to a temperature of between 800 and 1100° F. In some embodiments, the feedstock is an aluminum alloy heated to a temperature of between 850 and 1100° F. In some embodiments, the feedstock is an aluminum alloy heated to a temperature of between 900 and 1100° F. In some embodiments, the feedstock is an aluminum alloy heated to a temperature of between 950 and 1100° F. In some embodiments, the feedstock is an aluminum alloy heated to a temperature of between 1000 and 1100° F. In some embodiments, the feedstock is an aluminum alloy heated to a temperature of between 1050 and 1100° F.

In some embodiments, the feedstock is a copper alloy heated to a temperature between 700 and 1700° F. In some embodiments, the feedstock is a copper alloy heated to a temperature of between 700 and 1650° F. In some embodiments, the feedstock is a copper alloy heated to a temperature of between 700 and 1600° F. In some embodiments, the feedstock is a copper alloy heated to a temperature of between 700 and 1500° F. In some embodiments, the feedstock is a copper alloy heated to a temperature of between 700 and 1400° F. In some embodiments, the feedstock is a copper alloy heated to a temperature of between 700 to 1300° F. In some embodiments, the feedstock is a copper alloy heated to a temperature of between 700 to 1200° F. In some embodiments, the feedstock is a copper alloy heated to a temperature of between 700 to 1100° F. In some embodiments, the feedstock is a copper alloy heated to a temperature of between 700 to 1000° F. In some embodiments, the feedstock is a copper alloy heated to a temperature of between 700 to 900° F. In some embodiments, the feedstock is a copper alloy heated to a temperature of between 700 to 800° F.

In some embodiments, the feedstock is a copper alloy heated to a temperature of between 650 and 1700° F. In some embodiments, the feedstock is a copper alloy heated to a temperature of between 700 and 1700° F. In some embodiments, the feedstock is a copper alloy heated to a temperature of between 800 and 1700° F. In some embodiments, the feedstock is a copper alloy heated to a temperature of between 900 and 1700° F. In some embodiments, the feedstock is a copper alloy heated to a temperature of between 1000 and 1700° F. In some embodiments, the feedstock is a copper alloy heated to a temperature of between 1100 and 1700° F. In some embodiments, the feedstock is a copper alloy heated to a temperature of between 1200 and 1700° F. In some embodiments, the feedstock is a copper alloy heated to a temperature of between 1300 and 1700° F. In some embodiments, the feedstock is a copper alloy heated to a temperature of between 1400 and 1700° F. In some embodiments, the feedstock is a copper alloy heated to a temperature of between 1500 and 1700° F. In some embodiments, the feedstock is a copper alloy heated to a temperature of between 1600 and 1700° F.

In some embodiments, the feedstock is a magnesium alloy heated to a temperature between 550 and 930° F. In some embodiments, the feedstock is a magnesium alloy heated to a temperature of between 550 and 900° F. In some embodiments, the feedstock is a magnesium alloy heated to a temperature of between 550 and 850° F. In some embodiments, the feedstock is a magnesium alloy heated to a temperature of between 550 and 800° F. In some embodiments, the feedstock is a magnesium alloy heated to a temperature of between 550 and 750° F. In some embodiments, the feedstock is a magnesium alloy heated to a temperature of between 550 to 700° F. In some embodiments, the feedstock is a magnesium alloy heated to a temperature of between 550 to 650° F. In some embodiments, the feedstock is a magnesium alloy heated to a temperature of between 550 to 600° F.

In some embodiments, the feedstock is a magnesium alloy heated to a temperature of between 600 and 930° F. In some embodiments, the feedstock is a magnesium alloy heated to a temperature of between 650 and 930° F. In some embodiments, the feedstock is a magnesium alloy heated to a temperature of between 700 and 930° F. In some embodiments, the feedstock is a magnesium alloy heated to a temperature of between 750 and 930° F. In some embodiments, the feedstock is a magnesium alloy heated to a temperature of between 800 and 930° F. In some embodiments, the feedstock is a magnesium alloy heated to a temperature of between 850 and 930° F. In some embodiments, the feedstock is a magnesium alloy heated to a temperature of between 900 and 930° F.

In some embodiments, the feedstock is a nickel alloy heated to a temperature between 1400 and 2260° F. In some embodiments, the feedstock is a nickel alloy heated to a temperature of between 1400 and 2200° F. In some embodiments, the feedstock is a nickel alloy heated to a temperature of between 1400 and 2100° F. In some embodiments, the feedstock is a nickel alloy heated to a temperature of between 1400 and 2000° F. In some embodiments, the feedstock is a nickel alloy heated to a temperature of between 1400 and 1900° F. In some embodiments, the feedstock is a nickel alloy heated to a temperature of between 1400 to 1800° F. In some embodiments, the feedstock is a nickel alloy heated to a temperature of between 1400 to 1700° F. In some embodiments, the feedstock is a nickel alloy heated to a temperature of between 1400 to 1600° F. In some embodiments, the feedstock is a nickel alloy heated to a temperature of between 1400 to 1500° F.

In some embodiments, the feedstock is a nickel alloy heated to a temperature of between 1450 and 2260° F. In some embodiments, the feedstock is a nickel alloy heated to a temperature of between 1500 and 2260° F. In some embodiments, the feedstock is a nickel alloy heated to a temperature of between 1600 and 2260° F. In some embodiments, the feedstock is a nickel alloy heated to a temperature of between 1700 and 2260° F. In some embodiments, the feedstock is a nickel alloy heated to a temperature of between 1800 and 2260° F. In some embodiments, the feedstock is a nickel alloy heated to a temperature of between 1900 and 2260° F. In some embodiments, the feedstock is a nickel alloy heated to a temperature of between 2000 and 2260° F. In some embodiments, the feedstock is a nickel alloy heated to a temperature of between 2100 and 2260° F.

In some embodiments, the feedstock is a titanium alloy heated to a temperature between 1200 and 1850° F. In some embodiments, the feedstock is a titanium alloy heated to a temperature of between 1200 and 1800° F. In some embodiments, the feedstock is a titanium alloy heated to a temperature of between 1200 and 1700° F. In some embodiments, the feedstock is a titanium alloy heated to a temperature of between 1200 and 1600° F. In some embodiments, the feedstock is a titanium alloy heated to a temperature of between 1200 and 1500° F. In some embodiments, the feedstock is a titanium alloy heated to a temperature of between 1200 to 1400° F. In some embodiments, the feedstock is a titanium alloy heated to a temperature of between 1200 to 1300° F.

In some embodiments, the feedstock is a titanium alloy heated to a temperature of between 1250 and 1800° F. In some embodiments, the feedstock is a titanium alloy heated to a temperature of between 1300 and 1800° F. In some embodiments, the feedstock is a titanium alloy heated to a temperature of between 1400 and 1800° F. In some embodiments, the feedstock is a titanium alloy heated to a temperature of between 1500 and 1800° F. In some embodiments, the feedstock is a titanium alloy heated to a temperature of between 1600 and 1800° F. In some embodiments, the feedstock is a titanium alloy heated to a temperature of between 1700 and 1800° F.

In some embodiments, the heated strip has a temper of T, O, or W. In some embodiments, the heated strip has a temper of T4 or T4X. In some embodiments, the heated strip is allowed to reach T4 or T4X temper at room temperature.

In some embodiments, the non-ferrous alloy is selected from the group consisting of 1xxx, 2xxx, 3xxx, 4xxx, 5xxx, 6xxx, 7xxx, and 8xxx series aluminum alloys. In some embodiments, the non-ferrous alloy is a 1xxx series aluminum alloy. In some embodiments, the non-ferrous alloy is a 2xxx series aluminum alloy. In some embodiments, the non-ferrous alloy is a 3xxx series aluminum alloy. In some embodiments, the non-ferrous alloy is a 4xxx series aluminum alloy. In some embodiments, the non-ferrous alloy is a 5xxx series aluminum alloy. In some embodiments, the non-ferrous alloy is a 6xxx series aluminum alloy. In some embodiments, the non-ferrous alloy is a 7xxx series aluminum alloy. In some embodiments, the non-ferrous alloy is an 8xxx series aluminum alloy.

In some embodiments, the non-ferrous alloy is selected from the non-heat treatable alloys selected from the group consisting of 1xxx, 3xxx, and 5xxx series aluminum alloys. In some embodiments, the non-ferrous alloy is selected from the heat treatable alloys selected from the group consisting of 2xxx, 6xxx, and 7xxx series aluminum alloys. In some embodiments, the non-ferrous alloy is selected from the group consisting of 4xxx and 8xxx series aluminum alloys. In some embodiments, the non-ferrous alloy is selected from the alloys selected from the group consisting of 2xxx, 3xxx, 5xxx, 6xxx, and 7xxx series aluminum alloys.

In some embodiments, the non-ferrous alloy is selected from the group consisting of 1xxx, 2xxx, and 3xxx series aluminum alloys. In some embodiments, the non-ferrous alloy is selected from the group consisting of 2xxx, 3xxx, and 4xxx series aluminum alloys. In some embodiments, the non-ferrous alloy is selected from the group consisting of 3xxx, 4xxx and 5xxx series aluminum alloys. In some embodiments, the non-ferrous alloy is selected from the group consisting of 4xxx, 5xxx, and 6xxx series aluminum alloys. In some embodiments, the non-ferrous alloy is selected from the group consisting of 5xxx, 6xxx, and 7xxx series aluminum alloys. In some embodiments, the non-ferrous alloy is selected from the group consisting of 6xxx, 7xxx, and 8xxx series aluminum alloys.

In some embodiments, the non-ferrous alloy is a 2xxx series aluminum alloy selected from the group consisting of AA2x24 (AA2024, AA2026, AA2524), AA2014, AA2029, AA2055, AA2060, AA2070, and AA2x99 (AA2099, AA2199).

In some embodiments, the non-ferrous alloy is a 3xxx series aluminum alloy selected from the group consisting of AA3004, AA3104, AA3204, AA3304, AA3005, and AA3105.

In some embodiments, the non-ferrous alloy is a 5xxx series aluminum alloy selected from the group consisting of AA5182, AA5754, and AA5042.

In some embodiments, the non-ferrous alloy is a 6xxx series aluminum alloy selected from the group consisting of AA6022, AA6111, AA6061, AA6013, AA6063, and AA6055.

In some embodiments, the non-ferrous alloy is a 7xxx series aluminum alloy selected from the group consisting of AA7x75 (AA7075, AA7175, AA7475), AA7010, AA7050, AA7150, AA7055, AA7255, AA7065, and AA7085.

In some embodiments, the non-ferrous alloy excludes aluminum alloys having all of the following: 0.4 weight percent silicon; less than 0.2 weight percent iron, 0.35 to 0.40 weight percent copper, 0.9 weight percent manganese, and 1 weight percent magnesium.

In some embodiments, the method includes heating the feedstock to a first temperature for a first time, T1, to achieve a product having a first temper. In some embodiments, the feedstock is an aluminum alloy and the first temperature ranges from 600 degrees F. to 1100 degrees F. and T1 ranges from 0.5 to 55 seconds. In some embodiments, the first temperature ranges from 600 degrees F. to 1100 degrees F. and T1 ranges from 0.5 to 50 seconds. In some embodiments, the first temperature ranges from 600 degrees F. to 1100 degrees F. and T1 ranges from 0.5 to 45 seconds. In some embodiments, the first temperature ranges from 600 degrees F. to 1100 degrees F. and T1 ranges from 0.5 to 35 seconds. In some embodiments, the first temperature ranges from 600 degrees F. to 1100 degrees F. and T1 ranges from 0.5 to 30 seconds. In some embodiments, the first temperature ranges from 600 degrees F. to 1100 degrees F. and T1 ranges from 0.5 to 20 seconds. In some embodiments, the first temperature ranges from 600 degrees F. to 1100 degrees F. and T1 ranges from 0.5 to 25 seconds. In some embodiments, the first temperature ranges from 600 degrees F. to 1100 degrees F. and T1 ranges from 0.5 to 20 seconds. In some embodiments, the first temperature ranges from 600 degrees F. to 1100 degrees F. and T1 ranges from 0.5 to 15 seconds. In some embodiments, the first temperature ranges from 600 degrees F. to 1100 degrees F. and T1 ranges from 0.5 to 10 seconds. In some embodiments, the first temperature ranges from 600 degrees F. to 1100 degrees F. and T1 ranges from 0.5 to 5 seconds. In some embodiments, the first temperature ranges from 600 degrees F. to 1100 degrees F. and T1 ranges from 0.5 to 3 seconds. In some embodiments, the first temperature ranges from 600 degrees F. to 1100 degrees F. and T1 ranges from 0.5 to 2 seconds. In some embodiments, the first temperature ranges from 600 degrees F. to 1100 degrees F. and T1 ranges from 0.5 to 1 second.

In some embodiments, the feedstock is an aluminum alloy and the first temperature ranges from 650 degrees F. to 1100 degrees F. and T1 ranges from 0.5 to 55 seconds. In some embodiments, the first temperature ranges from 700 degrees F. to 1100 degrees F. and T1 ranges from 0.5 to 55 seconds. In some embodiments, the first temperature ranges from 750 degrees F. to 1100 degrees F. and T1 ranges from 0.5 to 55 seconds. In some embodiments, the first temperature ranges from 800 degrees F. to 1100 degrees F. and T1 ranges from 0.5 to 55 seconds. In some embodiments, the first temperature ranges from 850 degrees F. to 1100 degrees F. and T1 ranges from 0.5 to 55 seconds. In some embodiments, the first temperature ranges from 600 degrees F. to 900 degrees F. and T1 ranges from 0.5 to 55 seconds. In some embodiments, the first temperature ranges from 950 degrees F. to 1100 degrees F. and T1 ranges from 0.5 to 55 seconds. In some embodiments, the first temperature ranges from 1000 degrees F. to 1100 degrees F. and T1 ranges from 0.5 to 55 seconds. In some embodiments, the first temperature ranges from 1050 degrees F. to 1100 degrees F. and T1 ranges from 0.5 to 55 seconds.

In some embodiments, the feedstock is an aluminum alloy and the first temperature ranges from 600 degrees F. to 1050 degrees F. and T1 ranges from 0.5 to 55 seconds. In some embodiments, the first temperature ranges from 600 degrees F. to 1000 degrees F. and T1 ranges from 0.5 to 55 seconds. In some embodiments, the first temperature ranges from 600 degrees F. to 950 degrees F. and T1 ranges from 0.5 to 55 seconds. In some embodiments, the first temperature ranges from 600 degrees F. to 900 degrees F. and T1 ranges from 0.5 to 55 seconds. In some embodiments, the first temperature ranges from 600 degrees F. to 850 degrees F. and T1 ranges from 0.5 to 55 seconds. In some embodiments, the first temperature ranges from 600 degrees F. to 800 degrees F. and T1 ranges from 0.5 to 55 seconds. In some embodiments, the first temperature ranges from 600 degrees F. to 750 degrees F. and T1 ranges from 0.5 to 55 seconds. In some embodiments, the first temperature ranges from 600 degrees F. to 700 degrees F. and T1 ranges from 0.5 to 55 seconds. In some embodiments, the first temperature ranges from 600 degrees F. to 650 degrees F. and T1 ranges from 0.5 to 55 seconds.

In some embodiments, the feedstock is a copper alloy and the first temperature ranges from 700 degrees F. to 1700 degrees F. and T1 ranges from 0.5 to 55 seconds. In some embodiments, the first temperature ranges from 700 degrees F. to 1700 degrees F. and T1 ranges from 0.5 to 50 seconds. In some embodiments, the first temperature ranges from 700 degrees F. to 1700 degrees F. and T1 ranges from 0.5 to 45 seconds. In some embodiments, the first temperature ranges from 700 degrees F. to 1700 degrees F. and T1 ranges from 0.5 to 35 seconds. In some embodiments, the first temperature ranges from 700 degrees F. to 1700 degrees F. and T1 ranges from 0.5 to 30 seconds. In some embodiments, the first temperature ranges from 700 degrees F. to 1700 degrees F. and T1 ranges from 0.5 to 20 seconds. In some embodiments, the first temperature ranges from 700 degrees F. to 1700 degrees F. and T1 ranges from 0.5 to 25 seconds. In some embodiments, the first temperature ranges from 700 degrees F. to 1700 degrees F. and T1 ranges from 0.5 to 20 seconds. In some embodiments, the first temperature ranges from 700 degrees F. to 1700 degrees F. and T1 ranges from 0.5 to 15 seconds. In some embodiments, the first temperature ranges from 700 degrees F. to 1700 degrees F. and T1 ranges from 0.5 to 10 seconds. In some embodiments, the first temperature ranges from 700 degrees F. to 1700 degrees F. and T1 ranges from 0.5 to 5 seconds. In some embodiments, the first temperature ranges from 700 degrees F. to 1700 degrees F. and T1 ranges from 0.5 to 3 seconds. In some embodiments, the first temperature ranges from 700 degrees F. to 1700 degrees F. and T1 ranges from 0.5 to 2 seconds. In some embodiments, the first temperature ranges from 700 degrees F. to 1700 degrees F. and T1 ranges from 0.5 to 1 second.

In some embodiments, the feedstock is a copper alloy and the first temperature ranges from 750 degrees F. to 1700 degrees F. and T1 ranges from 0.5 to 55 seconds. In some embodiments, the first temperature ranges from 800 degrees F. to 1700 degrees F. and T1 ranges from 0.5 to 55 seconds. In some embodiments, the first temperature ranges from 850 degrees F. to 1700 degrees F. and T1 ranges from 0.5 to 55 seconds. In some embodiments, the first temperature ranges from 900 degrees F. to 1700 degrees F. and T1 ranges from 0.5 to 55 seconds. In some embodiments, the first temperature ranges from 950 degrees F. to 1700 degrees F. and T1 ranges from 0.5 to 55 seconds. In some embodiments, the first temperature ranges from 1000 degrees F. to 1700 degrees F. and T1 ranges from 0.5 to 55 seconds. In some embodiments, the first temperature ranges from 1100 degrees F. to 1700 degrees F. and T1 ranges from 0.5 to 55 seconds. In some embodiments, the first temperature ranges from 1200 degrees F. to 1700 degrees F. and T1 ranges from 0.5 to 55 seconds. In some embodiments, the first temperature ranges from 1300 degrees F. to 1700 degrees F. and T1 ranges from 0.5 to 55 seconds. In some embodiments, the first temperature ranges from 1400 degrees F. to 1700 degrees F. and T1 ranges from 0.5 to 55 seconds. In some embodiments, the first temperature ranges from 1500 degrees F. to 1700 degrees F. and T1 ranges from 0.5 to 55 seconds. In some embodiments, the first temperature ranges from 1600 degrees F. to 1700 degrees F. and T1 ranges from 0.5 to 55 seconds. In some embodiments, the first temperature ranges from 900 degrees F. to 1500 degrees F. and T1 ranges from 0.5 to 55 seconds. In some embodiments, the first temperature ranges from 1000 degrees F. to 1300 degrees F. and T1 ranges from 0.5 to 55 seconds. In some embodiments, the first temperature ranges from 900 degrees F. to 1200 degrees F. and T1 ranges from 0.5 to 55 seconds.

In some embodiments, the feedstock is a copper alloy and the first temperature ranges from 700 degrees F. to 1600 degrees F. and T1 ranges from 0.5 to 55 seconds. In some embodiments, the first temperature ranges from 700 degrees F. to 1500 degrees F. and T1 ranges from 0.5 to 55 seconds. In some embodiments, the first temperature ranges from 700 degrees F. to 1400 degrees F. and T1 ranges from 0.5 to 55 seconds. In some embodiments, the first temperature ranges from 700 degrees F. to 1300 degrees F. and T1 ranges from 0.5 to 55 seconds. In some embodiments, the first temperature ranges from 700 degrees F. to 1200 degrees F. and T1 ranges from 0.5 to 55 seconds. In some embodiments, the first temperature ranges from 700 degrees F. to 1100 degrees F. and T1 ranges from 0.5 to 55 seconds. In some embodiments, the first temperature ranges from 700 degrees F. to 1000 degrees F. and T1 ranges from 0.5 to 55 seconds. In some embodiments, the first temperature ranges from 700 degrees F. to 900 degrees F. and T1 ranges from 0.5 to 55 seconds.

In some embodiments, the feedstock is a magnesium alloy and the first temperature ranges from 550 degrees F. to 930 degrees F. and T1 ranges from 0.5 to 55 seconds. In some embodiments, the first temperature ranges from 550 degrees F. to 930 degrees F. and T1 ranges from 0.5 to 50 seconds. In some embodiments, the first temperature ranges from 550 degrees F. to 930 degrees F. and T1 ranges from 0.5 to 45 seconds. In some embodiments, the first temperature ranges from 550 degrees F. to 930 degrees F. and T1 ranges from 0.5 to 35 seconds. In some embodiments, the first temperature ranges from 550 degrees F. to 930 degrees F. and T1 ranges from 0.5 to 30 seconds. In some embodiments, the first temperature ranges from 550 degrees F. to 930 degrees F. and T1 ranges from 0.5 to 20 seconds. In some embodiments, the first temperature ranges from 550 degrees F. to 930 degrees F. and T1 ranges from 0.5 to 25 seconds. In some embodiments, the first temperature ranges from 550 degrees F. to 930 degrees F. and T1 ranges from 0.5 to 20 seconds. In some embodiments, the first temperature ranges from 550 degrees F. to 930 degrees F. and T1 ranges from 0.5 to 15 seconds. In some embodiments, the first temperature ranges from 550 degrees F. to 930 degrees F. and T1 ranges from 0.5 to 10 seconds. In some embodiments, the first temperature ranges from 550 degrees F. to 930 degrees F. and T1 ranges from 0.5 to 5 seconds. In some embodiments, the first temperature ranges from 550 degrees F. to 930 degrees F. and T1 ranges from 0.5 to 3 seconds. In some embodiments, the first temperature ranges from 550 degrees F. to 930 degrees F. and T1 ranges from 0.5 to 2 seconds. In some embodiments, the first temperature ranges from 550 degrees F. to 930 degrees F. and T1 ranges from 0.5 to 1 second.

In some embodiments, the feedstock is a magnesium alloy and the first temperature ranges from 600 degrees F. to 930 degrees F. and T1 ranges from 0.5 to 55 seconds. In some embodiments, the first temperature ranges from 650 degrees F. to 930 degrees F. and T1 ranges from 0.5 to 55 seconds. In some embodiments, the first temperature ranges from 700 degrees F. to 930 degrees F. and T1 ranges from 0.5 to 55 seconds. In some embodiments, the first temperature ranges from 750 degrees F. to 930 degrees F. and T1 ranges from 0.5 to 55 seconds. In some embodiments, the first temperature ranges from 800 degrees F. to 930 degrees F. and T1 ranges from 0.5 to 55 seconds. In some embodiments, the first temperature ranges from 850 degrees F. to 930 degrees F. and T1 ranges from 0.5 to 55 seconds. In some embodiments, the first temperature ranges from 900 degrees F. to 930 degrees F. and T1 ranges from 0.5 to 55 seconds.

In some embodiments, the feedstock is a magnesium alloy and the first temperature ranges from 550 degrees F. to 900 degrees F. and T1 ranges from 0.5 to 55 seconds. In some embodiments, the first temperature ranges from 550 degrees F. to 850 degrees F. and T1 ranges from 0.5 to 55 seconds. In some embodiments, the first temperature ranges from 550 degrees F. to 800 degrees F. and T1 ranges from 0.5 to 55 seconds. In some embodiments, the first temperature ranges from 550 degrees F. to 750 degrees F. and T1 ranges from 0.5 to 55 seconds. In some embodiments, the first temperature ranges from 550 degrees F. to 700 degrees F. and T1 ranges from 0.5 to 55 seconds. In some embodiments, the first temperature ranges from 550 degrees F. to 650 degrees F. and T1 ranges from 0.5 to 55 seconds. In some embodiments, the first temperature ranges from 550 degrees F. to 600 degrees F. and T1 ranges from 0.5 to 55 seconds. In some embodiments, the first temperature ranges from 650 degrees F. to 900 degrees F. and T1 ranges from 0.5 to 55 seconds. In some embodiments, the first temperature ranges from 700 degrees F. to 800 degrees F. and T1 ranges from 0.5 to 55 seconds.

In some embodiments, the feedstock is a nickel alloy and the first temperature ranges from 1400 degrees F. to 2260 degrees F. and T1 ranges from 0.5 to 55 seconds. In some embodiments, the first temperature ranges from 1400 degrees F. to 2260 degrees F. and T1 ranges from 0.5 to 50 seconds. In some embodiments, the first temperature ranges from 1400 degrees F. to 2260 degrees F. and T1 ranges from 0.5 to 45 seconds. In some embodiments, the first temperature ranges from 1400 degrees F. to 2260 degrees F. and T1 ranges from 0.5 to 35 seconds. In some embodiments, the first temperature ranges from 1400 degrees F. to 2260 degrees F. and T1 ranges from 0.5 to 30 seconds. In some embodiments, the first temperature ranges from 1400 degrees F. to 2260 degrees F. and T1 ranges from 0.5 to 20 seconds. In some embodiments, the first temperature ranges from 1400 degrees F. to 2260 degrees F. and T1 ranges from 0.5 to 25 seconds. In some embodiments, the first temperature ranges from 1400 degrees F. to 2260 degrees F. and T1 ranges from 0.5 to 20 seconds. In some embodiments, the first temperature ranges from 1400 degrees F. to 2260 degrees F. and T1 ranges from 0.5 to 15 seconds. In some embodiments, the first temperature ranges from 1400 degrees F. to 2260 degrees F. and T1 ranges from 0.5 to 10 seconds. In some embodiments, the first temperature ranges from 1400 degrees F. to 2260 degrees F. and T1 ranges from 0.5 to 5 seconds. In some embodiments, the first temperature ranges from 1400 degrees F. to 2260 degrees F. and T1 ranges from 0.5 to 3 seconds. In some embodiments, the first temperature ranges from 1400 degrees F. to 2260 degrees F. and T1 ranges from 0.5 to 2 seconds. In some embodiments, the first temperature ranges from 1400 degrees F. to 2260 degrees F. and T1 ranges from 0.5 to 1 second.

In some embodiments, the feedstock is a nickel alloy and the first temperature ranges from 1500 degrees F. to 2260 degrees F. and T1 ranges from 0.5 to 55 seconds. In some embodiments, the first temperature ranges from 1600 degrees F. to 2260 degrees F. and T1 ranges from 0.5 to 55 seconds. In some embodiments, the first temperature ranges from 1700 degrees F. to 2260 degrees F. and T1 ranges from 0.5 to 55 seconds. In some embodiments, the first temperature ranges from 1800 degrees F. to 2260 degrees F. and T1 ranges from 0.5 to 55 seconds. In some embodiments, the first temperature ranges from 1900 degrees F. to 2260 degrees F. and T1 ranges from 0.5 to 55 seconds. In some embodiments, the first temperature ranges from 2000 degrees F. to 2260 degrees F. and T1 ranges from 0.5 to 55 seconds. In some embodiments, the first temperature ranges from 2100 degrees F. to 2260 degrees F. and T1 ranges from 0.5 to 55 seconds.

In some embodiments, the feedstock is a nickel alloy and the first temperature ranges from 1400 degrees F. to 2100 degrees F. and T1 ranges from 0.5 to 55 seconds. In some embodiments, the first temperature ranges from 1400 degrees F. to 2000 degrees F. and T1 ranges from 0.5 to 55 seconds. In some embodiments, the first temperature ranges from 1400 degrees F. to 1900 degrees F. and T1 ranges from 0.5 to 55 seconds. In some embodiments, the first temperature ranges from 1400 degrees F. to 1800 degrees F. and T1 ranges from 0.5 to 55 seconds. In some embodiments, the first temperature ranges from 1400 degrees F. to 1700 degrees F. and T1 ranges from 0.5 to 55 seconds. In some embodiments, the first temperature ranges from 1400 degrees F. to 1600 degrees F. and T1 ranges from 0.5 to 55 seconds. In some embodiments, the first temperature ranges from 1400 degrees F. to 1500 degrees F. and T1 ranges from 0.5 to 55 seconds. In some embodiments, the first temperature ranges from 1500 degrees F. to 2100 degrees F. and T1 ranges from 0.5 to 55 seconds. In some embodiments, the first temperature ranges from 1600 degrees F. to 2000 degrees F. and T1 ranges from 0.5 to 55 seconds. In some embodiments, the first temperature ranges from 1700 degrees F. to 1900 degrees F. and T1 ranges from 0.5 to 55 seconds.

In some embodiments, the feedstock is a titanium alloy and the first temperature ranges from 1200 degrees F. to 1850 degrees F. and T1 ranges from 0.5 to 55 seconds. In some embodiments, the first temperature ranges from 1200 degrees F. to 1850 degrees F. and T1 ranges from 0.5 to 50 seconds. In some embodiments, the first temperature ranges from 1200 degrees F. to 1850 degrees F. and T1 ranges from 0.5 to 45 seconds. In some embodiments, the first temperature ranges from 1200 degrees F. to 1850 degrees F. and T1 ranges from 0.5 to 35 seconds. In some embodiments, the first temperature ranges from 1200 degrees F. to 1850 degrees F. and T1 ranges from 0.5 to 30 seconds. In some embodiments, the first temperature ranges from 1200 degrees F. to 1850 degrees F. and T1 ranges from 0.5 to 20 seconds. In some embodiments, the first temperature ranges from 1200 degrees F. to 1850 degrees F. and T1 ranges from 0.5 to 25 seconds. In some embodiments, the first temperature ranges from 1200 degrees F. to 1850 degrees F. and T1 ranges from 0.5 to 20 seconds. In some embodiments, the first temperature ranges from 1200 degrees F. to 1850 degrees F. and T1 ranges from 0.5 to 15 seconds. In some embodiments, the first temperature ranges from 1200 degrees F. to 1850 degrees F. and T1 ranges from 0.5 to 10 seconds. In some embodiments, the first temperature ranges from 1200 degrees F. to 1850 degrees F. and T1 ranges from 0.5 to 5 seconds. In some embodiments, the first temperature ranges from 1200 degrees F. to 1850 degrees F. and T1 ranges from 0.5 to 3 seconds. In some embodiments, the first temperature ranges from 1200 degrees F. to 1850 degrees F. and T1 ranges from 0.5 to 2 seconds. In some embodiments, the first temperature ranges from 1200 degrees F. to 1850 degrees F. and T1 ranges from 0.5 to 1 second.

In some embodiments, the feedstock is a titanium alloy and the first temperature ranges from 1300 degrees F. to 1850 degrees F. and T1 ranges from 0.5 to 55 seconds. In some embodiments, the first temperature ranges from 1400 degrees F. to 1850 degrees F. and T1 ranges from 0.5 to 55 seconds. In some embodiments, the first temperature ranges from 1500 degrees F. to 1850 degrees F. and T1 ranges from 0.5 to 55 seconds. In some embodiments, the first temperature ranges from 1600 degrees F. to 1850 degrees F. and T1 ranges from 0.5 to 55 seconds. In some embodiments, the first temperature ranges from 1700 degrees F. to 1850 degrees F. and T1 ranges from 0.5 to 55 seconds. In some embodiments, the first temperature ranges from 1800 degrees F. to 1850 degrees F. and T1 ranges from 0.5 to 55 seconds.

In some embodiments, the feedstock is a titanium alloy and the first temperature ranges from 1200 degrees F. to 1800 degrees F. and T1 ranges from 0.5 to 55 seconds. In some embodiments, the first temperature ranges from 1200 degrees F. to 1700 degrees F. and T1 ranges from 0.5 to 55 seconds. In some embodiments, the first temperature ranges from 1200 degrees F. to 1600 degrees F. and T1 ranges from 0.5 to 55 seconds. In some embodiments, the first temperature ranges from 1200 degrees F. to 1500 degrees F. and T1 ranges from 0.5 to 55 seconds. In some embodiments, the first temperature ranges from 1200 degrees F. to 1400 degrees F. and T1 ranges from 0.5 to 55 seconds. In some embodiments, the first temperature ranges from 1200 degrees F. to 1300 degrees F. and T1 ranges from 0.5 to 55 seconds. In some embodiments, the first temperature ranges from 1300 degrees F. to 1800 degrees F. and T1 ranges from 0.5 to 55 seconds. In some embodiments, the first temperature ranges from 1400 degrees F. to 1700 degrees F. and T1 ranges from 0.5 to 55 seconds. In some embodiments, the first temperature ranges from 1500 degrees F. to 1600 degrees F. and T1 ranges from 0.5 to 55 seconds.

In some embodiments, the heated strip has a temper of T, O, or W. In some embodiments, the heated strip has a temper of T4 or T4X. In some embodiments, the heated strip is allowed to reach T4 or T4X temper at room temperature.

In some embodiments, the non-ferrous alloy is selected from the group consisting of 1xxx, 2xxx, 3xxx, 4xxx, 5xxx, 6xxx, 7xxx, and 8xxx series aluminum alloys. In some embodiments, the non-ferrous alloy is a 1xxx series aluminum alloy. In some embodiments, the non-ferrous alloy is a 2xxx series aluminum alloy. In some embodiments, the non-ferrous alloy is a 3xxx series aluminum alloy. In some embodiments, the non-ferrous alloy is a 4xxx series aluminum alloy. In some embodiments, the non-ferrous alloy is a 5xxx series aluminum alloy. In some embodiments, the non-ferrous alloy is a 6xxx series aluminum alloy. In some embodiments, the non-ferrous alloy is a 7xxx series aluminum alloy. In some embodiments, the non-ferrous alloy is an 8xxx series aluminum alloy.

In some embodiments, the non-ferrous alloy is selected from the non-heat treatable alloys selected from the group consisting of 1xxx, 3xxx, and 5xxx series aluminum alloys. In some embodiments, the non-ferrous alloy is selected from the heat treatable alloys selected from the group consisting of 2xxx, 6xxx, and 7xxx series aluminum alloys. In some embodiments, the non-ferrous alloy is selected from the group consisting of 4xxx and 8xxx series aluminum alloys. In some embodiments, the non-ferrous alloy is selected from the alloys selected from the group consisting of 2xxx, 3xxx, 5xxx, 6xxx, and 7xxx series aluminum alloys.

In some embodiments, the non-ferrous alloy is selected from the group consisting of 1xxx, 2xxx, and 3xxx series aluminum alloys. In some embodiments, the non-ferrous alloy is selected from the group consisting of 2xxx, 3xxx, and 4xxx series aluminum alloys. In some embodiments, the non-ferrous alloy is selected from the group consisting of 3xxx, 4xxx and 5xxx series aluminum alloys. In some embodiments, the non-ferrous alloy is selected from the group consisting of 4xxx, 5xxx, and 6xxx series aluminum alloys. In some embodiments, the non-ferrous alloy is selected from the group consisting of 5xxx, 6xxx, and 7xxx series aluminum alloys. In some embodiments, the non-ferrous alloy is selected from the group consisting of 6xxx, 7xxx, and 8xxx series aluminum alloys.

In some embodiments, the non-ferrous alloy is a 2xxx series aluminum alloy selected from the group consisting of AA2x24 (AA2024, AA2026, AA2524), AA2014, AA2029, AA2055, AA2060, AA2070, and AA2x99 (AA2099, AA2199).

In some embodiments, the non-ferrous alloy is a 3xxx series aluminum alloy selected from the group consisting of AA3004, AA3104, AA3204, AA3304, AA3005, and AA3105.

In some embodiments, the non-ferrous alloy is a 5xxx series aluminum alloy selected from the group consisting of AA5182, AA5754, and AA5042.

In some embodiments, the non-ferrous alloy is a 6xxx series aluminum alloy selected from the group consisting of AA6022, AA6111, AA6061, AA6013, AA6063, and AA6055.

In some embodiments, the non-ferrous alloy is a 7xxx series aluminum alloy selected from the group consisting of AA7x75 (AA7075, AA7175, AA7475), AA7010, AA7050, AA7150, AA7055, AA7255, AA7065, and AA7085.

Figure 2:
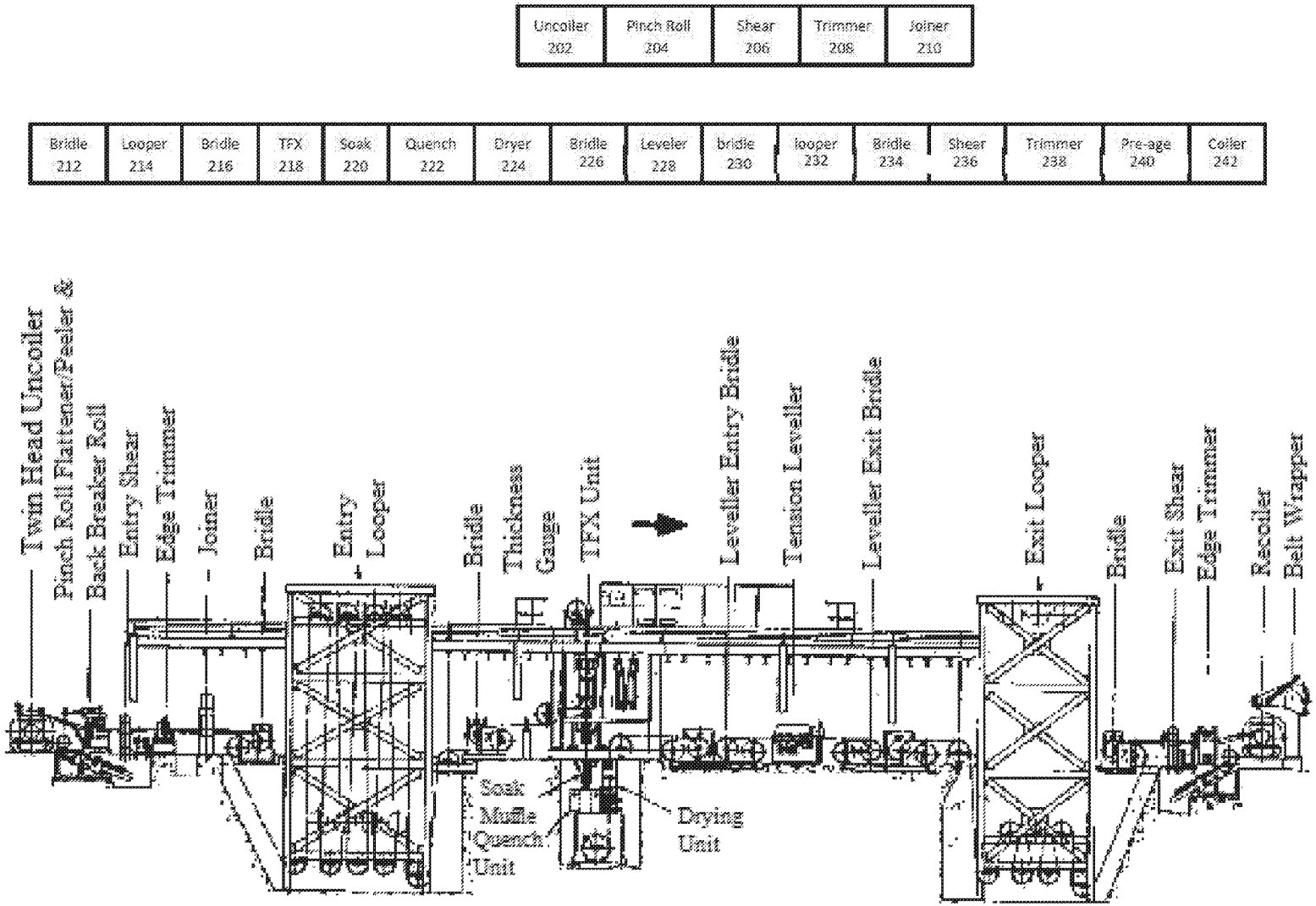
FIG. 2 illustrates features of some embodiments of the present invention.
Figure 3:
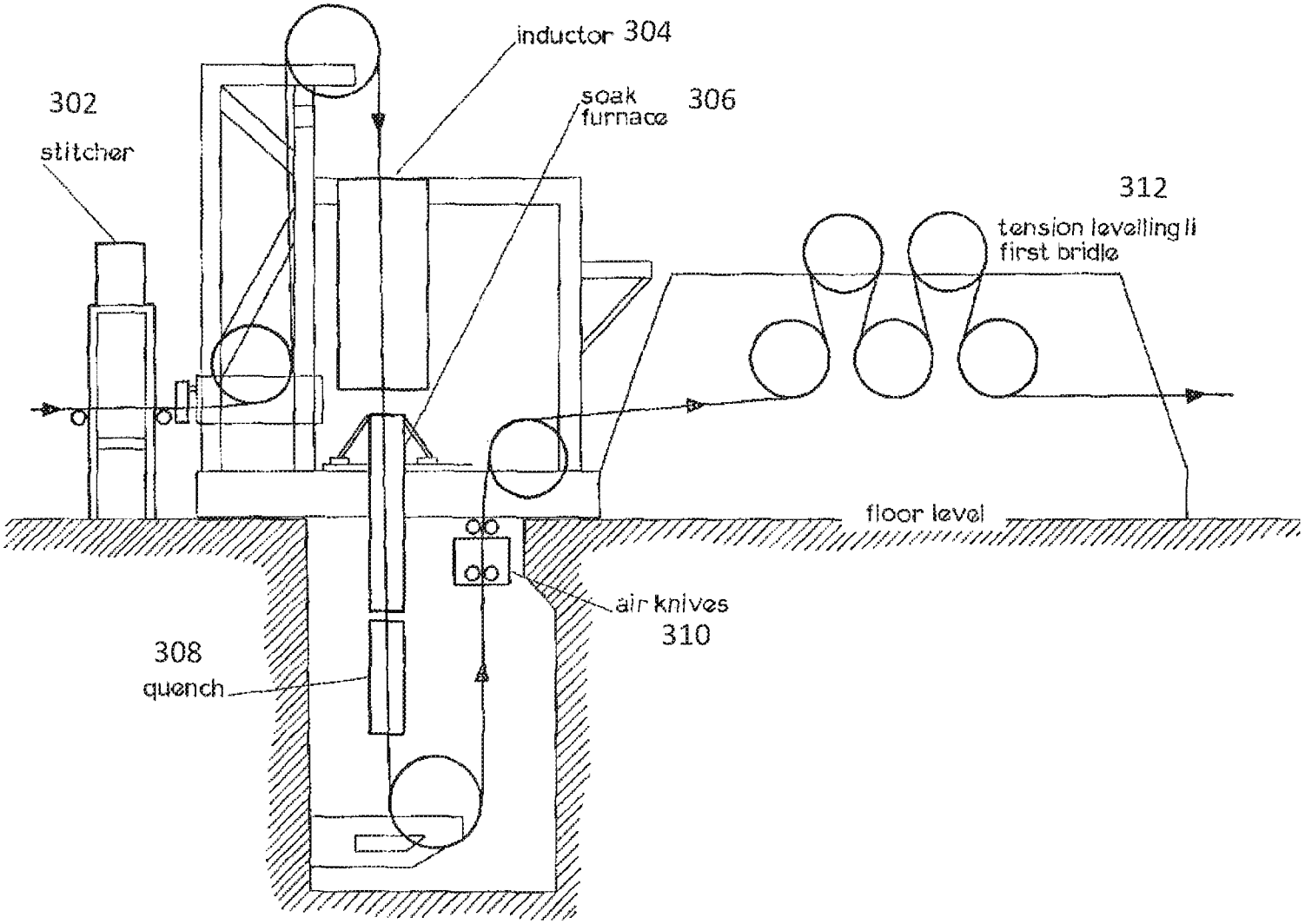
FIG. 3 illustrates features of some embodiments of the present invention.

In some embodiments, FIG. 1 is a flow chart of the steps of the method of the present invention. In some embodiments, FIG. 2 is a schematic diagram of one embodiment of the apparatus used to carrying out the method of the present invention. In some embodiments, FIG. 3 is a schematic diagram of one embodiment of the apparatus used in carrying out the method of the present invention.

In some embodiments, the method includes the process detailed in FIG. 1. In some embodiments, the feedstock 20 is formed from a continuously cast non-ferrous alloy strip 1 that is subjected to one or more of the following processing steps detailed in FIG. 1: passing through one or more shear and trim stations 2, optional quenching for temperature adjustment 4, one or more hot rolling and/or cold rolling steps 6, trimming 8 and coiling 10 to form feedstock 20.

In some embodiments, the feedstock is subjected to one or more of the following steps: uncoiling 22 followed by either annealing 26, quenching 28 and/or coiling 30 to produce O temper strips 32, or solution heat treatment 40, followed by suitable quenching 42 and optional coiling 44 to produce T temper strips 46. In some embodiments, the annealing step 26 and/or the solution heat treatment step 40 are conducted using the heating methods, temperature ranges, and heating durations detailed herein.

In some embodiments, an embodiment of an apparatus used to carry out the method of the present invention using induction heating is shown in FIG. 2. In some embodiments, the feedstock is processed in a horizontal heat treatment unit as shown in FIG. 2. In some embodiments, the method includes use of an uncoiler 202 to uncoil the coiled feedstock. In some embodiments, the uncoiled feedstock is then fed to a pinch roll 204, shear 206, trimmer 208, and joiner 210. In some embodiments, the feedstock is then fed to a bridle 212, a looper 214, and another bridle 216. In some embodiments, the resultant feedstock is then fed one or more induction heaters 218 configured for TFIH. In some embodiments, the heated feedstock is then subjected to a soak 220, a quench 222 and a dryer 224. In some embodiments, the dried, heated feedstock is then fed to a bridle 226, leveler 228, and another bridle 230. In some embodiments, the feedstock is then fed to a lopper 232, a bridle 234, and then subjected to a shear 236, a trimmer 238, a pre-aging step 240 and then run through a coiler 242 to form a coiled strip.

In some embodiments, the quench 222 may include, but is not limited to, liquid sprays, gas, gas followed by liquid, and/or liquid followed by gas. In some embodiments, the pre-aging step may include, but is not limited to, induction heating, infrared heating, muffle furnace or liquid sprays. In some embodiments, the pre-age unit is positioned before the coiler 242. In some embodiments, artificial aging can be carried out either as a part of subsequent operations (such as paint bake cycle) or as a separate step in an oven.

In some embodiments, an embodiment of an apparatus used to carry out the method of the present invention using induction heating is shown in FIG. 3. In some embodiments, the apparatus or the method includes a stitcher 302, an inductor 304 configured for TFIH, a soak furnace 306, a quench 308, air knives 310 and a tension leveling line first bridle 312.

Prophetic Example 1

An aluminum alloy is processed by the method of the present invention. The aluminum alloy selected is a 6022 Alloy having the following composition:

| Element | Percentage by weight |
|---|---|
| Si | 0.8 |
| Fe | 0.1 |
| Cu | 0.1 |
| Mn | 0.1 |
| Mg | 0.7 |
| Al | Remainder |

The alloy is cast to a thickness of 0.085 inch at 250 feet per minute speed and is processed by hot rolling in one step to a finish gauge of 0.035 inches and then coiled. The coiled product is then uncoiled and heated to a temperature of 850° F. for 3 seconds for solution heat treatment after which it is quenched to 60° F. by means of water sprays and is coiled. Samples are then removed from the outermost wraps of the coil, One set of samples is allowed to stabilize at room temperature for 4-10 days to reach T4 temper. A second set is subjected to a special pre-aging treatment at 180° F. for 8 hours before it is stabilized. This special temper is called T43.

Prophetic Example 2

A magnesium alloy is processed by the method of the present invention. The magnesium alloy selected is AZ91D having the following composition:

| Element | Percentage by weight |
|---|---|
| Al | 8.5-9.5 |
| Be | 0.0005-0.0015 |
| Cu (max.) | 0.025 |
| Fe (max.) | 0.004 |
| Mn | 0.17-0.40 |
| Ni (max.) | 0.001 |
| Si | 0.08 |
| Zn | 0.45-0.9 |
| Other Metals | 0.01 |
| Mg | Remainder |

The alloy is cast to a thickness of 0.085 inch at 250 feet per minute speed and is processed by hot rolling in one step to a finish gauge of 0.035 inches and then coiled. The coiled product is then uncoiled and heated to a temperature of 850° F. for 3 seconds for solution heat treatment after which it is quenched to 160° F. by means of water sprays and is coiled. Samples are then removed from the outermost wraps of the coil. One set of samples is allowed to stabilize at room temperature for 4-10 days to reach T4 temper. A second set is subjected to a special pre aging treatment at 180° F. for 8 hours before it is stabilized. This special temper is called T43.

While a number of embodiments of the present invention have been described, it is understood that these embodiments are illustrative only, and not restrictive, and that many modifications may become apparent to those of ordinary skill in the art. Further still, the various steps may be carried out in any desired order (and any desired steps may be added and/or any desired steps may be eliminated).

We claim:

1. A method comprising:

preparing a non-ferrous alloy strip as feedstock, the preparing consisting of:

(a) continuously casting the non-ferrous alloy strip, (b) passing the non-ferrous alloy strip through one or more shear and trim stations, (c) optionally quenching the non-ferrous alloy strip for temperature adjustment, (d) when step (c) is present, after step (c), hot rolling the non-ferrous alloy strip, when step (c) is not present, after step (b), hot rolling the non-ferrous alloy strip, (e) optionally cold rolling the non-ferrous alloy strip, (f) trimming the non-ferrous alloy strip, and (g) coiling the non-ferrous alloy strip, thereby containing the coil of the non-ferrous alloy strip as the feedstock;

uncoiling the coil of the feedstock;

heating the feedstock to a temperature between a recrystallization temperature of the non-ferrous alloy and 10 degrees Fahrenheit below a solidus temperature of the non-ferrous alloy in an induction furnace including one or more induction heaters configured for transverse flux induction heating; and quenching the feedstock to form a heat-treated product having a temper;

wherein the temper is a T4 or T4X temper; and wherein the non-ferrous alloy strip excludes aluminum alloys having all of the following:

0.4 weight percent silicon, less than 0.2 weight percent iron, 0.35 to 0.40 weight percent copper, 0.9 weight percent manganese, and 1 weight percent magnesium.

2. The method of claim 1, wherein the non-ferrous alloy is selected from the group consisting of aluminum alloys, magnesium alloys, titanium alloys, copper alloys, nickel alloys, zinc alloys and tin alloys.

3. The method of claim 2, wherein the non-ferrous alloy is an aluminum alloy selected from the group consisting of 2xxx, 3xxx, 6xxx, 7xxx, and 8xxx series aluminum alloys.

4. The method of claim 2, wherein the non-ferrous alloy is a magnesium alloy.

5. The method of claim 1, further comprising recoiling the heat-treated product to form a second coil.

6. The method of claim 1, wherein the heating temperature is between the recrystallization temperature of the non-ferrous alloy and 30 degrees Fahrenheit below the solidus temperature of the non-ferrous alloy.

7. The method of claim 1, wherein the heating temperature is between the recrystallization temperature of the non-ferrous alloy and 60 degrees Fahrenheit below the solidus temperature of the non-ferrous alloy.

8. The method of claim 1, wherein the heating temperature is between the recrystallization temperature of the non-ferrous alloy and 85 degrees Fahrenheit below the solidus temperature of the non-ferrous alloy.

9. The method of claim 1, wherein the non-ferrous alloy is aluminum alloy and the heating temperature is between 600 and 1100 degrees Fahrenheit.

10. The method of claim 1, wherein the non-ferrous alloy is magnesium alloy and the heating temperature is between 550 and 930 degrees Fahrenheit.

11. A method comprising:

preparing a coil of a non-ferrous alloy strip as feedstock, the preparing consisting of:

(a) continuously casting the non-ferrous alloy strip, (b) passing the non-ferrous alloy strip through one or more shear and trim stations, (c) optionally quenching the non-ferrous alloy strip for temperature adjustment, (d) when step (c) is present, after step (c), hot rolling the non-ferrous alloy strip, when step (c) is not present, after step (b), hot rolling the non-ferrous alloy strip, (e) optionally cold rolling the non-ferrous alloy strip, (f) trimming the non-ferrous alloy strip, and (g) coiling the non-ferrous alloy strip, thereby containing the coil of the non-ferrous alloy strip as the feedstock;

uncoiling the coil of the feedstock;

heating the feedstock to a temperature between a recrystallization temperature of the non-ferrous alloy and 10 degrees Fahrenheit below a solidus temperature of the non-ferrous alloy for a heating duration of 0.5 to 55 seconds in an induction furnace including one or more induction heaters configured for transverse flux induction heating; and quenching the feedstock to form a heat-treated product having a temper;

wherein the temper is a T4 or T4X temper; and wherein the non-ferrous alloy strip excludes aluminum alloys having all of the following:

0.4 weight percent silicon, less than 0.2 weight percent iron, 0.35 to 0.40 weight percent copper, 0.9 weight percent manganese, and 1 weight percent magnesium.

12. The method of claim 11, wherein the non-ferrous alloy is selected from the group consisting of aluminum alloys, magnesium alloys, titanium alloys, copper alloys, nickel alloys, zinc alloys and tin alloys.

13. The method of claim 11, wherein the non-ferrous alloy is an aluminum alloy selected from the group consisting of 2xxx, 3xxx, 6xxx, 7xxx, and 8xxx series aluminum alloys.

14. The method of claim 11, wherein the non-ferrous alloy is a magnesium alloy.

15. The method of claim 11, wherein the heating duration is 0.5 to 20 seconds.

16. The method of claim 15, wherein the heating duration is 0.5 to 10 seconds.

17. The method of claim 11, wherein the non-ferrous alloy is an aluminum alloy and the heating temperature is between 600 and 1100 degrees Fahrenheit.

18. The method of claim 11, wherein the non-ferrous alloy is magnesium alloy and the heating temperature is between 550 and 930 degrees Fahrenheit.

* * * * *